US007396264B2

(12) United States Patent
Cheng

(10) Patent No.: US 7,396,264 B2
(45) Date of Patent: Jul. 8, 2008

(54) ELECTRICAL-TAP CONNECTOR

(75) Inventor: I-Tien Cheng, Chang Hwa (TW)

(73) Assignee: K.S. Terminals, Inc., Chang Hwa (TW)

( * ) Notice: Subject to any disclaimer, the term of this patent is extended or adjusted under 35 U.S.C. 154(b) by 0 days.

(21) Appl. No.: 11/415,309

(22) Filed: May 2, 2006

(65) Prior Publication Data

US 2007/0259558 A1 Nov. 8, 2007

(51) Int. Cl.
*H01R 11/22* (2006.01)

(52) U.S. Cl. ..... 439/857

(58) Field of Classification Search ..... 439/398, 439/845, 395, 857
See application file for complete search history.

(56) References Cited

U.S. PATENT DOCUMENTS

| | | | | |
|---|---|---|---|---|
| 4,124,265 A | | 11/1978 | Turk | 339/97 |
| 4,317,608 A | | 3/1982 | Dechelette | 339/99 |
| 4,519,663 A | * | 5/1985 | De Luca | 439/404 |
| 4,527,852 A | | 7/1985 | Dechelette | 339/97 |
| 4,553,808 A | | 11/1985 | Weidler et al. | 339/97 |
| 4,943,248 A | | 7/1990 | Colleran et al. | 439/850 |
| 5,290,176 A | | 3/1994 | Soes et al. | 439/398 |
| 5,399,098 A | | 3/1995 | Marshall et al. | 439/398 |
| 5,582,519 A | | 12/1996 | Buchter | 439/101 |
| 5,667,414 A | | 9/1997 | Karacora | 439/849 |
| 6,086,405 A | | 7/2000 | Liebich | 439/397 |
| 6,290,531 B1 | | 9/2001 | Onizuka et al. | 439/397 |
| 6,309,234 B1 | | 10/2001 | Hattori et al. | 439/189 |
| 6,398,580 B2 | | 6/2002 | Lin et al. | 439/402 |
| 6,416,347 B2 | | 7/2002 | Kojima | 439/397 |
| 6,616,476 B1 | | 9/2003 | Moritz et al. | 439/404 |

* cited by examiner

*Primary Examiner*—Neil Abrams
*Assistant Examiner*—Phuong Nguyen
(74) *Attorney, Agent, or Firm*—Ming Chow; Sinorica, LLC

(57) ABSTRACT

An electrical-tap connector has a blade-receiving portion and a wire-receiving portion for connecting a wire and a blade contact. The electrical-tap connector includes an integrally insulated housing which mounts a generally W-shaped metal sheet therein. The generally W-shaped metal sheet includes a pair of apexes and a pit therebetween. The respective one ends of the apexes are joined by a parallel leg portions with free ends at the end of the leg portions. A transverse slot is defined in the transverse direction of the generally parallel leg portions. A longitudinal slot is defined in the longitudinal direction of the free ends and an oblique face lead-in mouth is defined at the entrance of the longitudinal slot.

5 Claims, 8 Drawing Sheets

ELECTRICAL-TAP CONNECTOR

BACKGROUND OF THE INVENTION

1. Field of Invention

The present invention generally relates to the art of electrical-tap connectors and, particularly to a stamped electrical-tap connector assembly having a wire-receiving portion at one end and a blade-receiving portion at the other end.

2. Description of Related Art

In the modern digital era, for the system functioning well, the individual device or signal or electricity need to be connected together. Therefore, it needs many connectors to connect the above.

Many electrical connectors or terminals have been designed for receiving or mating with a male tab or blade contact. Such electrical connectors or terminals often are used in tap connectors for making a T-connection to an insulated electrical wire. In such connectors, one end of the terminal includes an insulation displacement terminal(i.e. IDT), wire-receiving portion, and the opposite end of the terminal includes a mating or blade-receiving portion.

Design considerations for these terminals must take into account the differing requirements for both sides of connections. On consideration of designing the insulation displacement end of the terminal, sufficient resistance is necessary against wire pulled-out, and sufficient integrity in the material thickness should be configured to displace the insulation without cutting the conductors and without allowing the insulation displacing slots to open. On consideration of designing the blade-receiving end of the terminal, the factors of a material thickness which does not take a set and which carries maximum current is necessary. General design-considerations, such as minimizing material waste and simplifying the design and manufacture of the terminals, also are important. According to the number of factors to be considered, most tap connectors often use stamped and formed terminals.

In a prior art, one type of stamped and formed terminal for connecting an insulated wire to a blade contact is disclosed in U.S. Pat. No. 5,399,089, referring to the FIG. 1, it includes an integrally formed insulated housing (20) which mounts a generally U-shaped metal sheet (22) therein for mating with a blade contact (14) which has a generally centrally located locking recess or aperture (30) therein. As seen in FIG. 2, the characteristic of the tap connectors is that the U-shape of the terminal (22) is defined by a pair of leg portions joined by a bight portion. The bight portion has an offset portion (46, 46*a*, 46*b*) which has a locking projection (48) therein for tightly engaging the locking recess (30) of the blade contact. Although the configuration of the generally U-shaped terminal provides the maximum current-carrying capacity of the terminal, the design of the offset portion (46, 46*a*, 46*b*) provides an uneven contact while the blade contact (14) is in mating engagement with the offset portion (46) of the blade-receiving terminal (22), thus reducing the reliability of the U-shaped terminal.

The present invention directed to solve these problems of prior invention provides an improved tap connector assembly not only to maximize the current-carrying capacity but also to increase the reliability and lifetime of the terminal by solving the problem of uneven contact.

SUMMARY OF THE INVENTION

The present invention provides an electrical-tap connector which has a blade-receiving portion and a wire-receiving portion for making a connection between a wire and a blade contact. The electrical-tap connector includes an integrally formed insulated housing which mounts a generally W-shaped metal sheet therein. The generally W-shaped metal sheet which is defined by a pair of generally parallel leg portions joined by the apexes and defined transverse slots for receiving a blade-contact, includes a pair of apexes and pits therebetween to form a blade-receiving portion. At the respective ends of leg portions have free ends defined longitudinal slots and formed lead-in mouth on the entrance for electrically connecting the wire without stripping or crimping.

Then the present invention provides a connector assembly including a one-piece housing of dielectric material which accepts a generally W-shaped terminal for electrically connecting an insulated electrical wire to a blade contact. In such connectors, one end of the terminal includes an insulation displacement, wire-receiving portion for electrically connecting the terminal to the insulated wire, and the opposite end of the terminal includes a mating or blade-receiving portion which is provided with a slot for receiving blade contact therethrough.

Meanwhile, a pair of mating dovetail-joint is positioned on the bilateral sides of the insulated housing for providing one type of configuration, so that multiple terminals may easily be paralleled facilitate the terminal for broader usage.

By providing a unique configuration of a generally W-shaped terminal for receiving a blade contact, the design according to the spirits of the present invention increases the lifetime of the terminal and allows the contact interface between the terminal and the blade contact to extend to the maximum, thus maximize the current-carrying capacity.

DETAILED DESCRIPTION OF THE PREFERRED EMBODIMENT

Because one type of stamped terminal for connecting an insulated wire to a blade contact which is mounted by an insulated housing has been disclosed in prior art, the following illustration doesn't make an integral description of it. The function of the drawings in the following contexts which aren't drawn in accordance with the real related dimension is to show the characteristic of the present invention.

Figure 3:
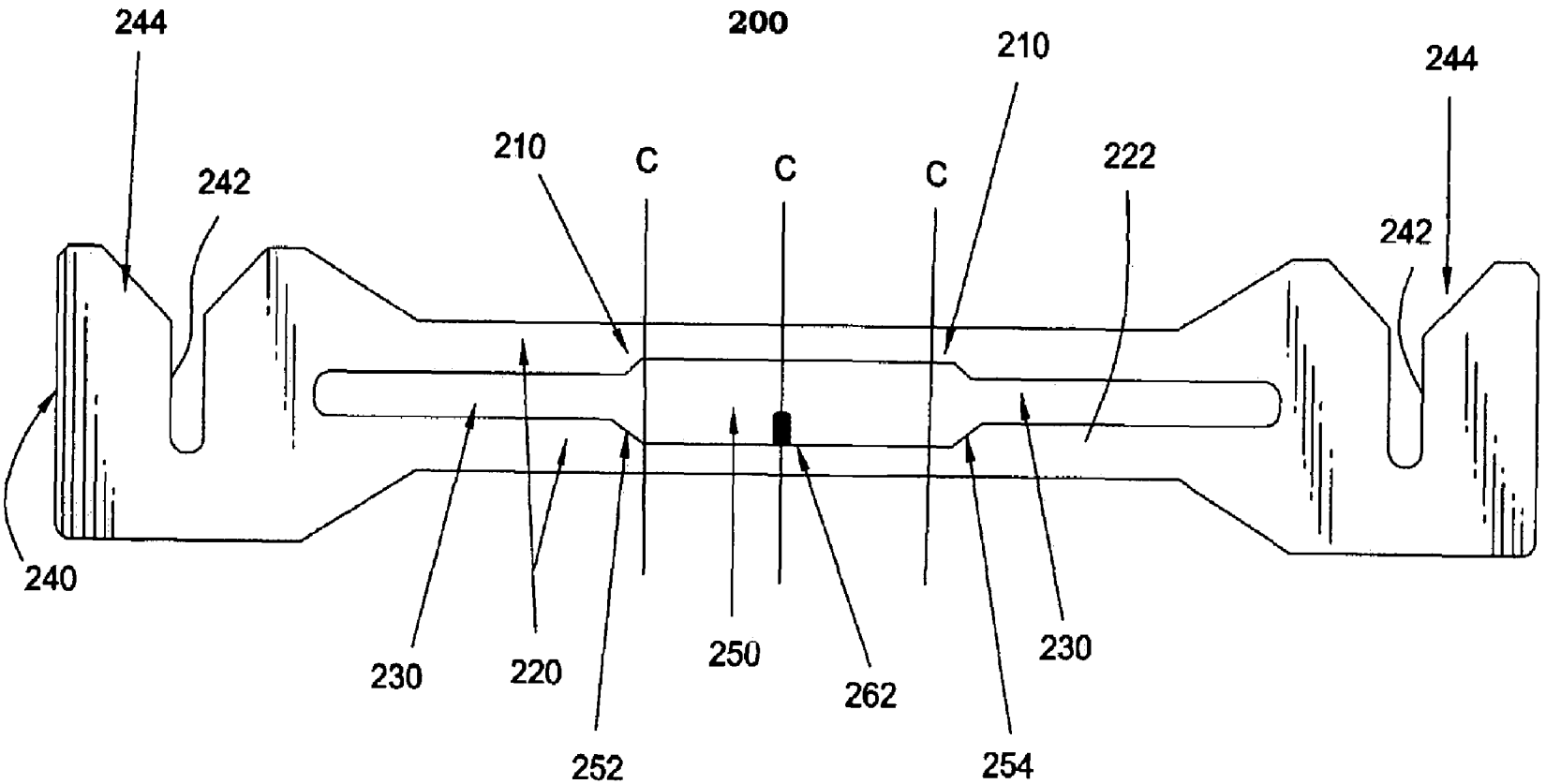
FIG. 3 is a side sectional view showing a metal stamped blank formation of present invention.

First to FIG. 3, is a configuration of stamped and formed metal sheet with a subsequently W-shaped blade-receiving terminal (200). The metal sheet showed in FIG. 3 includes a pair of leg portions (220,222) in which a transverse slot(230) is defined. The leg portions(220,222) are extended to have two free ends(240) on each which has a longitudinal slot (242). Besides, nearby the central area of the metal sheet has an enlarged transverse slot(250). The enlarged transverse slot (250) and the transverse slot (230)defined by the pair of leg portions(220,222) are connected by a pair of opposite oblique portions(252, 254). Meanwhile, the enlarged transverse slot (250) has a locking projection(262) located nearby central position. As seen in FIG. 3, the locking projection(262) of the transverse slot(250) is located inferiorly, buy not limited to. The locking projection(262) may be equipped either superiorly or both(superiorly and inferiorly), depending on the type of application. There are three dotted line area designated "C" respectively crossing the oblique portions(252,254) near the enlarged transverse slot(250) and the locking projection (262). The blank is formed or folded, approximately along areas designated "C", to yield the offset portion of the generally W-shaped terminal.

Figure 4:
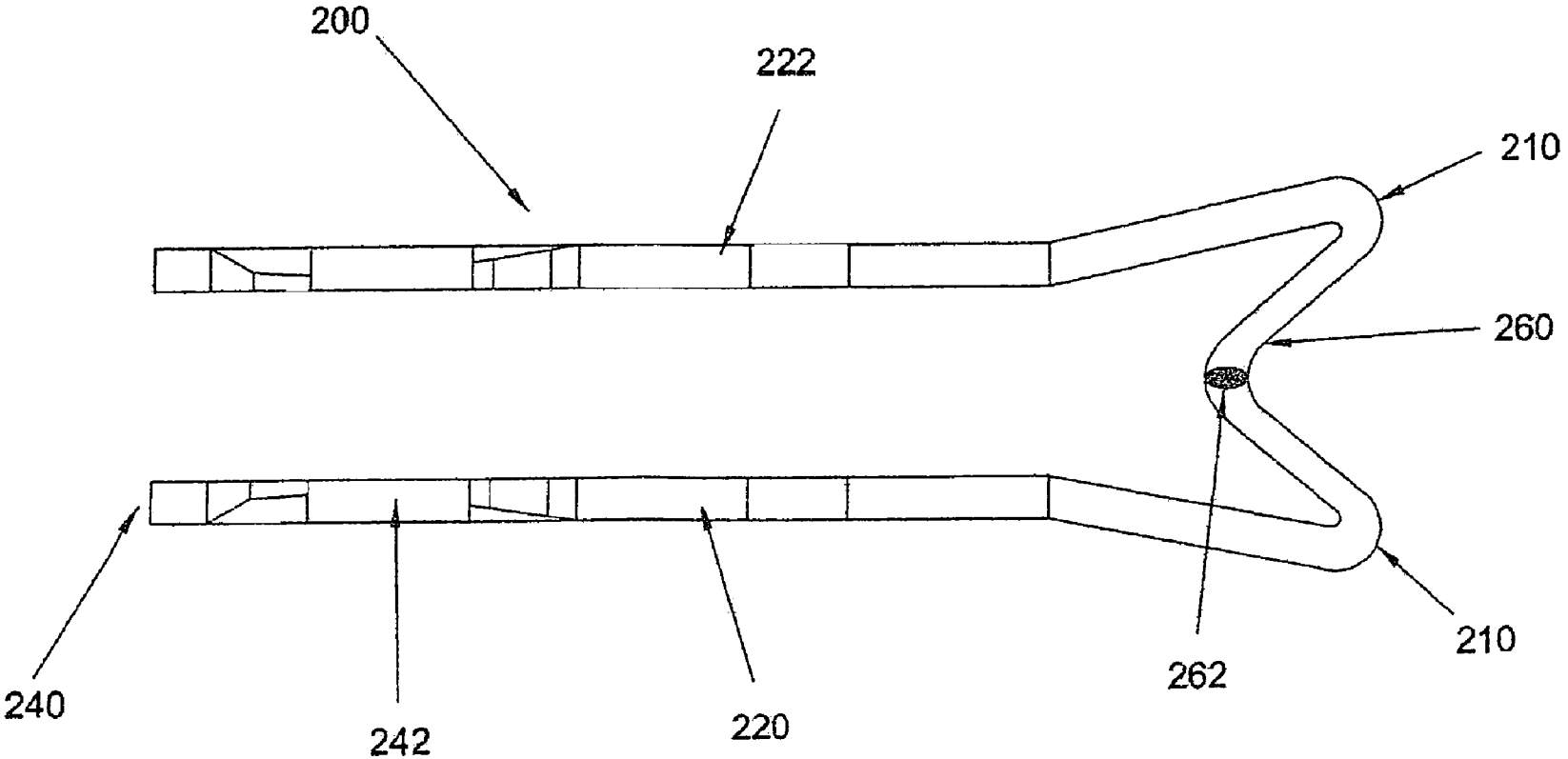
FIG. 4 is a top plan view showing the connector assembly of the present invention.

Referring now to FIG. 4, is a top plan view of the connector assembly of the present invention. With reference to the location of the three "C" in FIG. 3, the pattern of the connector is formed or folded by stamping or extruding procedure to form a W-shaped blade-receiving terminal (200) with a substantial closed end at one end and an free end at the other end. Because the generally W-shaped terminal(200) is stamped and formed by mechanical power, the two apexes(2 10) of the W-shaped blade-receiving terminal(200) are enlarged slightly toward both sides during the period of stamping and extruding procedures. The location of the locking projection(262) is just right on a pit(260) between the two relative apexes(210).

Figure 5:
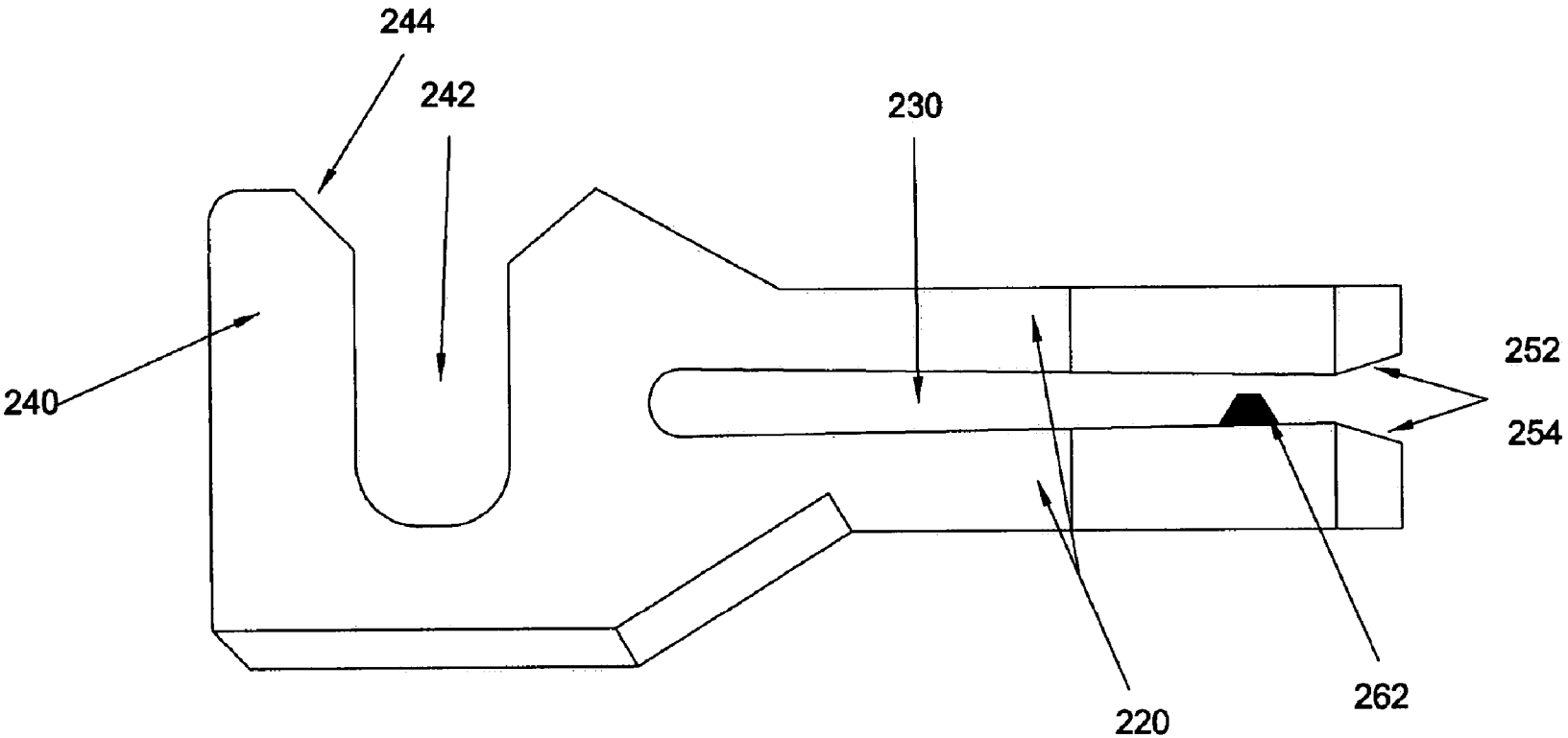
FIG. 5 is a side sectional view of the connector assembly in accordance with the present invention.

Referring now to FIG. 5 is a side sectional view of the connector assembly. After the formation of the generally W-shaped terminal(200), the outlet of the defined transverse slot(230) of the leg portions(220,222) provides a lead-in mouth. Apparently, such a structure of the outlet is formed by the relative oblique portions(252,254) to facilitate leading in the matching connector. Additionally, the defined longitudinal slot(242) by the free ends(240) also forms an offset portion(244) which is approximate a lead-in mouth for receiving the mating wire. The dimension of the transverse slot(230) and the longitudinal slot(242) may be modified, depending on the embodiment of the connector assembly.

Figure 1:
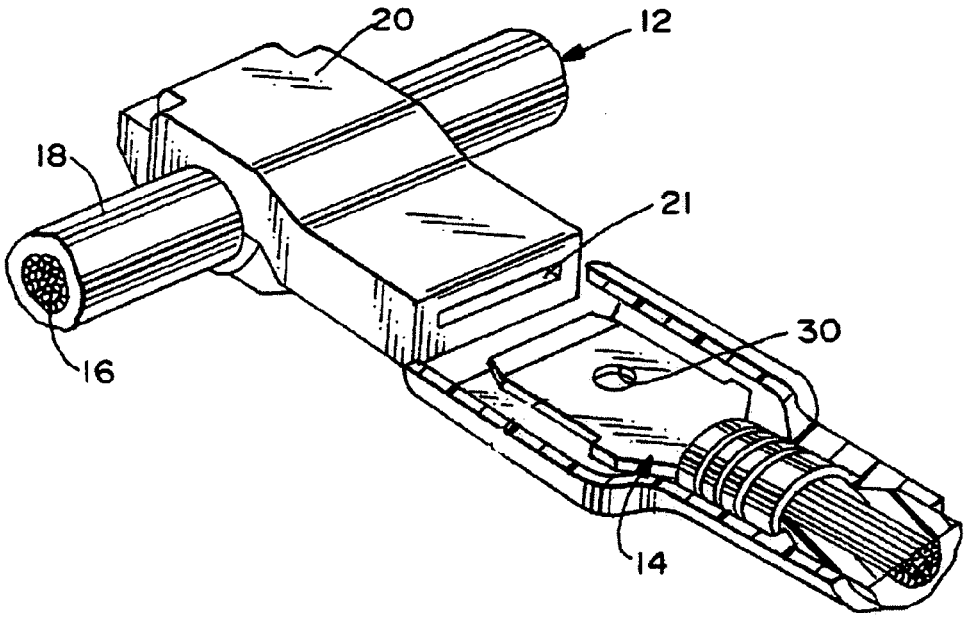
Fig.-1 Prior Art
FIG. 1 shows a prior art.
Figure 2:
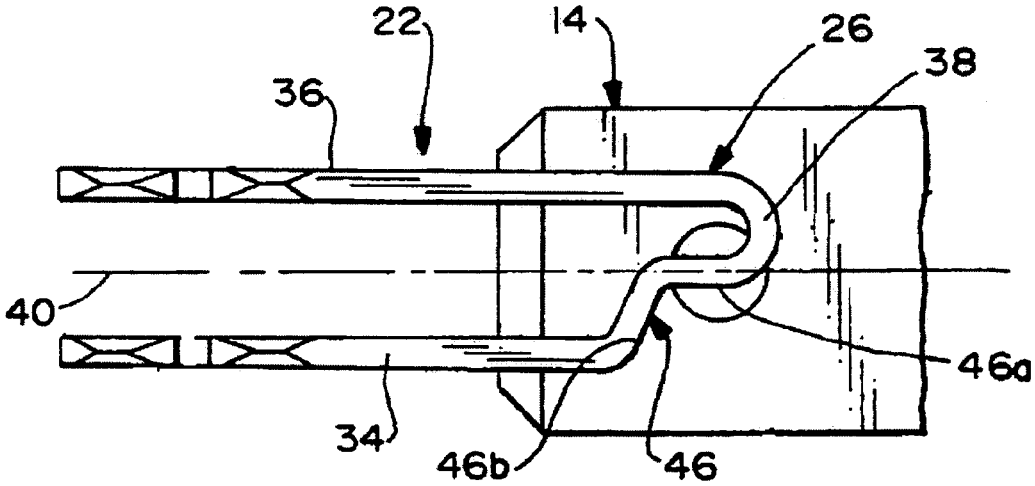
Fig.-2 Prior Art
FIG. 2 shows the prior art.
Figure 6:
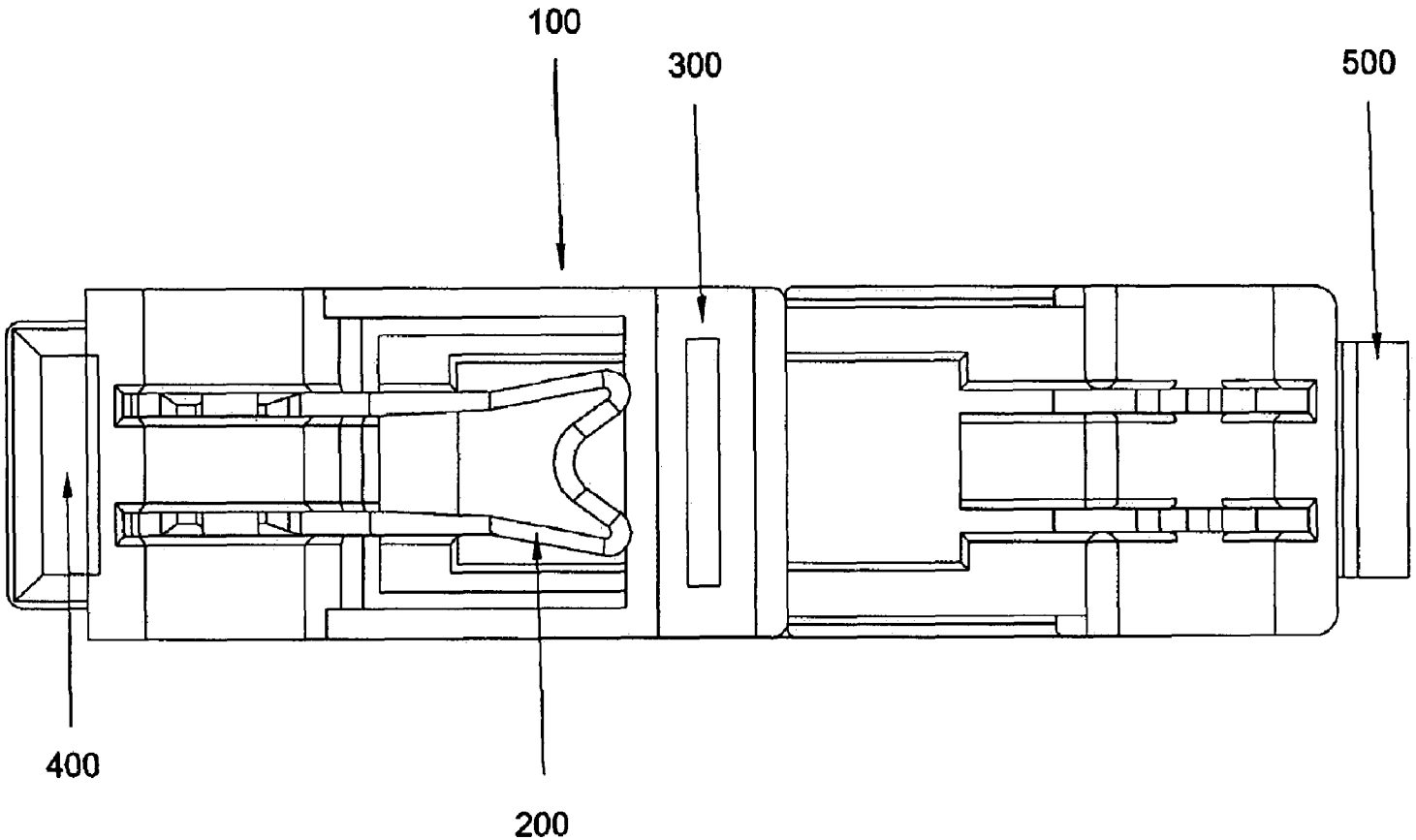
FIG. 6 shows an insulated housing which mounts the connector assembly therein

Referring now to FIG. 6, shows an insulated housing which mounts the connector assembly therein. In the embodiment of the present invention, the housing(100) is made of insulating material by molding or'injection-molding method. The main structure of the housing(100) includes not only an area which mounts a tap-connector assembly(200), but also a slot(300) which is located at the middle of the housing(100). The slot (300) which is relative to the slot(21) in FIG. 1 is configured as a route for receiving blade contact(14). In addition, the outermost of the housing(100) which mounts one end of the tap-connector assembly(200) is provided a female connecting interface(400) for mating engagement with a male connecting interface(500) which is opposite to the female connecting interface. Because the width of the male connecting interface(500) is larger than that of the female connecting interface(400), it facilitates the housing to be folded to the type of configuration in FIG. 1 when the male connecting interface(500) mates engagement with the female connecting interface(400).

The above is a detail description of the present invention, including the configuration of the tap-connector assembly (200) and the housing(100). Next, the connecting process of the connector assembly(200) is described with a wire(12) and a blade contact(14) furthermore.

Figure 7:
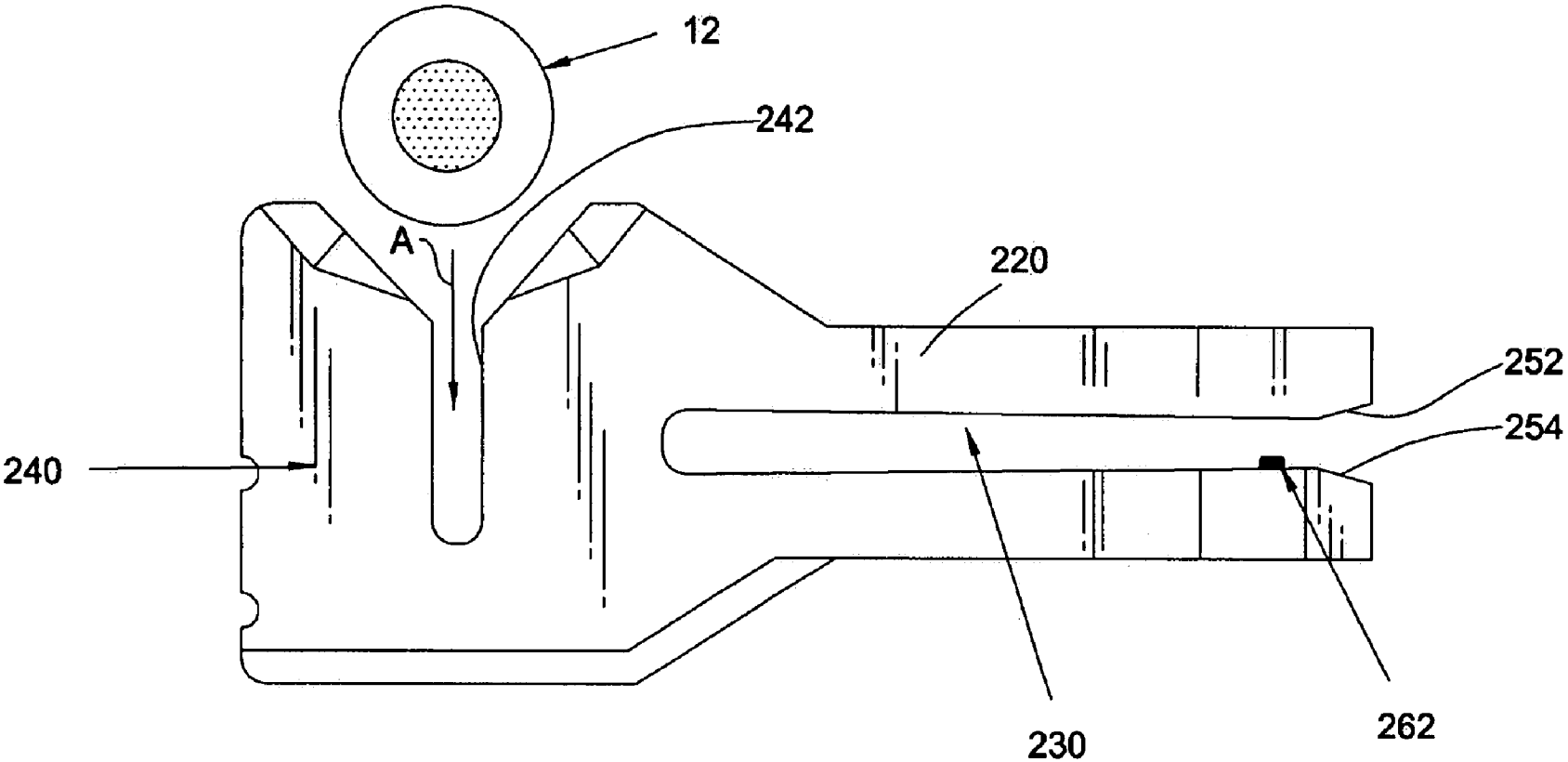
FIG. 7 shows the connector assembly in connecting with an insulated wire.

Referring to FIG. 7, shows the connector assembly in connecting with an insulated wire. After the connector assembly (200) is mounted therein by an insulated housing(100), an insulated electrical wire(12) is terminated to the offset portion (244) in the free end(240) of the terminal(200) in the direction of arrow "A". Because the width of the wire(12) is larger than that of the longitudinal slot(242) of the free end(240), the wire(12) is enforced into slot(242) in the direction of arrow "A" when the connector assembly(200) is folded. In the meantime, a cladding of insulation(18) surrounding the wire (12) will be torn by the border of the longitudinal slot(242) to make an electrical connection between a center conductor (16) of the wire(12) and the border of the longitudinal slot (242). By the elasticity of the insulation(18), a close connection is provided between the wire(12) and the slot(242) to reduce oxidation of the center conductor(16). After this step, the connector assembly may be formed to the generally T-shaped configuration as in the left part of FIG. 1.

Figure 8:
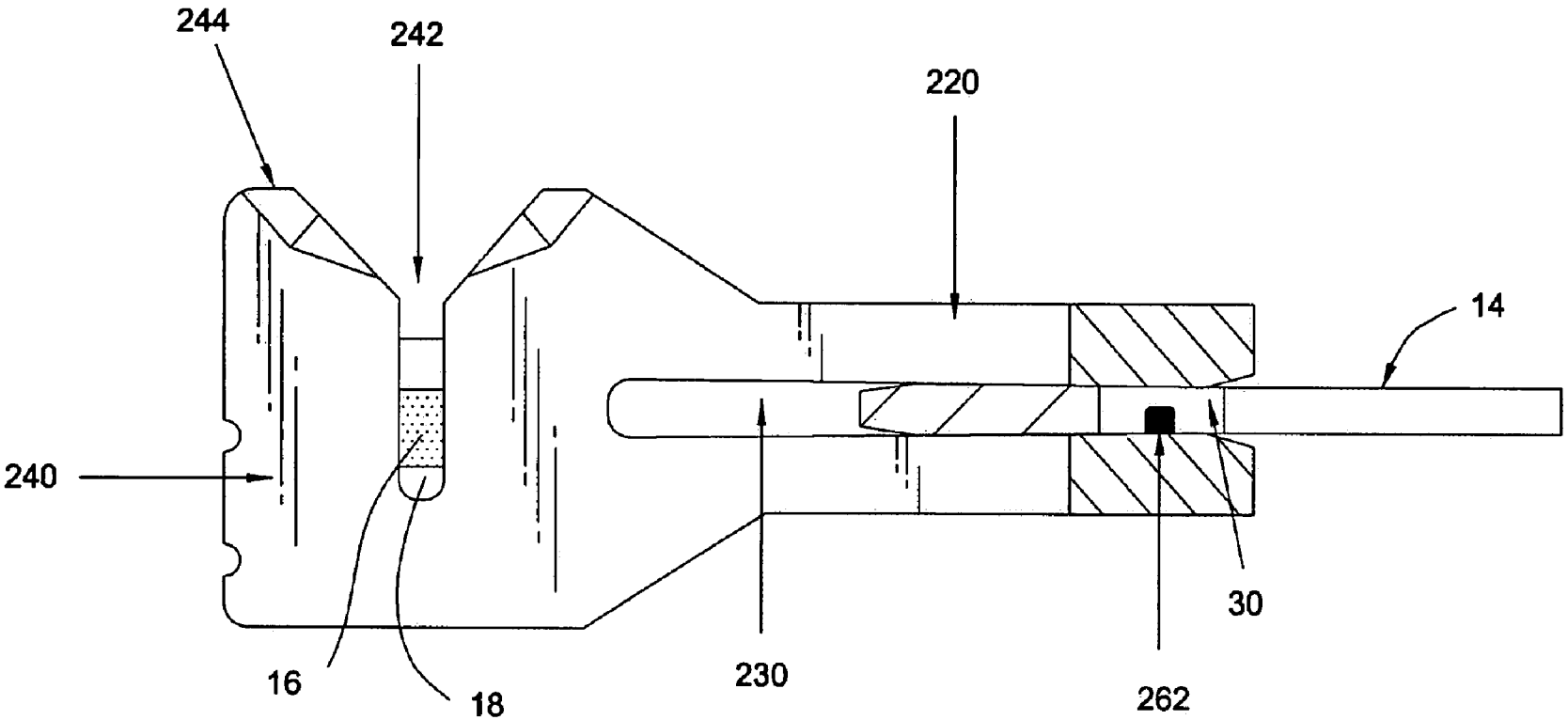
FIG. 8 shows the blade-receiving terminal in mating engagement with both a blade contact and an insulated wire.

Referring to FIG. 8 shows the blade-receiving terminal in mating engagement with both a blade contact and an insulated wire. When a blade contact (14) is inserted into the terminal through a slot(300) of the housing(100), the blade contact (14) contacts with a pair of generally W-shape apexes (210) of the connector assembly(200) immediately. Because the two apexes are approximately on the same plane and have the design of lead-in entrance, the integral connector assembly (200) receives symmetrical impact, thus increasing the lifetime of the terminal (200). When the blade contact (14) continues to extend inwardly, a locking recess or aperture (30) of the contact(14) locks engagement with a locking projection(262) located generally along middle of the terminal. It allows the electrical interface between the terminal (200) and the blade contact (14) to be maximized, thus maximizing the current-carrying capacity of the terminal (200). It's important to note that the embodiment of the present invention, the blade contact(14) may be a metal material of wire, cable or fuse.

Figure 9:
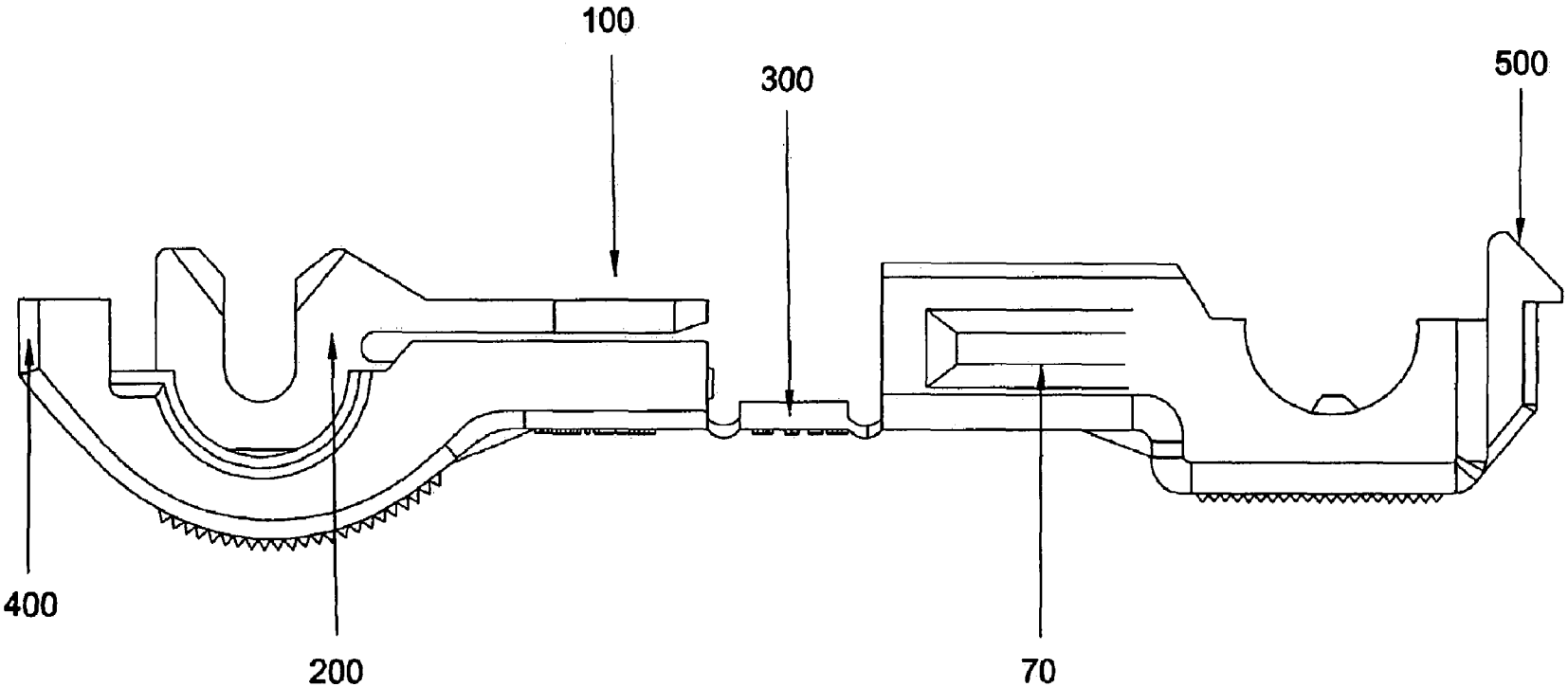
FIG. 9 is a side sectional view showing the connector assembly with dovetail-joint.

Next, FIG. 9 shows the connector assembly with dovetail-joint in accordance with one embodiment of the present invention. One type of configuration of multiple terminals may easily be paralleled for broader usage, i.e. making a mating connection of multiple batteries for increasing electrical current or making a parallel electrical connection. The major character of the connector assembly is the broader planar of a male connecting interface(500) of the housing (100). There is a dovetail-joint recess (female)(70) on one side and a dovetail-joint projection(male)(not shown) on the other, facilitating the parallel connection of the terminals with paired dovetail-joint. Furthermore, the dovetail-joint used in the embodiment of present invention does not limit the application of the present invention. Any configuration with generally T-shaped mating connection equipment provided connecting interface of the dovetail-joint for mating connection may be all applied to the present invention.

Above description is the preferred embodiment of the present invention only, not to limit the claim right of the present invention. The above description may be understood and applied by the experts of the art. So, any coequal change or modification without departing from the spirit of the art should be included in the following claim.

What is claimed is:

1. An electrical-tap connector for connecting a blade contact (14) to an insulated electrical wire (12), comprising:

an insulated housing (100) and a generally W-shaped metal sheet terminal (200) equipped within the housing (100), the generally W-shaped metal sheet terminal (200) including a pair of apexes (210) and a pit (260) therebetween, respective one end of the apexes (210) joined by a parallel leg portions(220,222) with free ends (240) at the end of the leg portions, wherein the pit (260) is equipped at least one locking projection (262);

a transverse slot (230) is defined in the transverse direction of the generally parallel leg portions (220, 222) and an oblique face lead-in mouth is defined at the entrance of the transverse slot (230); and a longitudinal slot (242) is defined in the longitudinal direction of the free ends (240) and an oblique face lead-in mouth (244) is defined at the entrance of the longitudinal slot (242).

2. The electrical-tap connector of claim 1, wherein the locking projection is equipped on the transverse slot superiorly, inferiorly or both.

3. An electrical-tap connector comprising an integrally formed insulated housing and a generally W-shaped metal sheet terminal mounted thereon, one end of the electrical-tap connector electrically coupled to a wire the other end thereof electrically coupled to a blade contact through a slot, wherein the characteristic of the generally W-shaped metal sheet terminal includes:

a pair of apexes and a pit therebetween, respective one end of the apexes joined by a parallel leg portions with free ends at the end of the leg portions, wherein the pit is equipped at least one locking projection;

a transverse slot is defined in the transverse direction of the generally parallel leg portions and an oblique face lead-in mouth is defined at the entrance of the transverse slot and electrically coupled to the generally W-shaped metal sheet terminal; and a longitudinal slot is defined in the longitudinal direction of the free ends and an oblique face lead-in mouth is defined at the entrance of the longitudinal slot and electrically coupled to the wire.

4. The electrical-tap connector of claim 3, wherein the locking projection is equipped on the transverse slot superiorly, inferiorly or both.

5. The electrical-tap connector of claim 3, wherein the blade contact is a metal material of wire, cable or fuse.

* * * * *